United States Patent [19]

Küttner et al.

[11] 4,345,559

[45] Aug. 24, 1982

[54] APPARATUS FOR DAMPING BOUNCE OSCILLATIONS IN AN INTERNAL COMBUSTION ENGINE

[75] Inventors: Thomas Küttner, Stuttgart; Wolf Wessel, Oberriexingen, both of Fed. Rep. of Germany

[73] Assignee: Robert Bosch GmbH, Stuttgart, Fed. Rep. of Germany

[21] Appl. No.: 122,100

[22] Filed: Feb. 15, 1980

[30] Foreign Application Priority Data

Feb. 27, 1979 [DE] Fed. Rep. of Germany ..... 2906782

[51] Int. Cl.[3] ..... F02B 47/00

[52] U.S. Cl. ..... 123/435; 123/436; 73/35

[58] Field of Search ..... 123/198 R, 436, 419, 123/435; 73/116, 35

[56] References Cited

U.S. PATENT DOCUMENTS

| | | | |
|---|---|---|---|
| 3,757,570 | 9/1973 | Cowley et al. | 73/116 |
| 3,789,816 | 2/1974 | Taplin et al. | 123/198 R |
| 4,044,234 | 8/1977 | Frobenius et al. | 123/436 |
| 4,169,371 | 10/1979 | Witschi et al. | 73/116 |
| 4,197,767 | 4/1980 | Leung | 123/436 |

*Primary Examiner*—P. S. Lall

*Attorney, Agent, or Firm*—Edwin E. Greigg

[57] ABSTRACT

An apparatus for damping bounce-induced oscillations in an internal combustion engine having a fuel metering control for supplying fuel to the engine in accordance with various operational signals, which includes an engine speed sensor for generating an rpm signal proportional to the engine rpm, a signal differentiation circuit for producing an rpm differential signal from the rpm signal, and a phase-shifting circuit, connected to receive the rpm differential signal, for supplying to the fuel metering control a bounce damping signal which is proportional to the rpm differential signal and which is phase-displaced with respect to the rpm differential signal so that the fuel metering control supplies fuel to the engine to countercontrol the bounce-induced oscillations of the engine. In a preferred embodiment, the phase-shifting circuit includes a controllable dead time element for varying the phase displacement in accordance with the bounce frequency so as to compensate for the total system transit time of the apparatus, to thus effect countercontrolling of the bounce oscillations which is correctly phased and correct in frequency.

26 Claims, 5 Drawing Figures

APPARATUS FOR DAMPING BOUNCE OSCILLATIONS IN AN INTERNAL COMBUSTION ENGINE

BACKGROUND OF THE INVENTION

The invention relates to a control system for internal combustion engines, and, in particular, to an engine control apparatus for damping the effects of bounced-induced oscillations on the engine.

The internal combustion engine of a vehicle, because of its elastic suspension, represents an entity capable of oscillations; in the event of disturbances such as an abrupt fuel increase or a sudden change in moment which is externally caused (by a pothole in the road, for instance), the engine can be set of oscillating in a more or less damped fashion. These oscillations are as a rule in the frequency range between 2 and 8 Hertz and are perceived as bounces. These bounce oscillations are particularly problematic in vehicles with a transverse mounted engine, because then the relative movements between the body and the engine arise in the driving direction.

A bounce sensor equipped with contacts is known, where there is one contact each on the engine and on the body. Because of the elastic suspension of the engine, the two pairs of contacts touch during intense bounce oscillations, or they separate. Relatively weaker or stronger oscillations can be detected depending on the position of the contacts, and the oscillations can then be evaluated in a manner not discussed here in further detail.

OBJECTS AND SUMMARY OF THE INVENTION

The study of these bounce oscillations and the search for a solution to the problem they present, or for a means of reducing them, have demonstrated that close attention must be paid to the individual system transit times. Particularly at high-frequency bounce oscillations (approximately 5 to 10 Hz), the reaction time dictated by the system (a fuel injection system, for example) is already of an order of magnitude of, for instance, one-fourth the period of the bounce oscillations. It is one of the objects of the invention to take into consideration this system reaction time in the countercontrolling of the individual control variables, such as the fuel injection quantity, and to create an apparatus with which these bounce oscillations, which are often dependent on resonance, can be at least greatly damped.

The apparatus in accordance with the invention for damping bounce oscillations in an internal combustion engine has the advantage of a countercontrol of the bounce oscillations which is optimal in terms of time, algebraic sign, and magnitude, with the bounce oscillations being detected on the basis of an rpm signal. The output line of the accelerator pedal position transducer has proved to be the appropriate intervention point, because the mixture composition or the fuel quantity to be injected can be influenced at this point in a quite simple manner.

A crankshaft rpm sensor supplies an rpm signal proportional to the engine rpm to a signal differentiation circuit, which generates an rpm differential signal proportional to the rate of change of said rpm signal with respect to time. The rpm differential signal is supplied to a countercontrol signal generating circuit, which generates a bounce damping signal whose magnitude and frequency is determined by the rpm differential signal, but which is displaced in time, or phase-shifted, from the rpm differential signal. The bounce damping signal is supplied to a fuel metering control which regulates fuel supplied to the engine to effect damping of the engine bounce oscillations. In a preferred embodiment of the invention, the countercontrol circuit includes an adjustable phase-shifting circuit for shifting the phase of the bounce damping signal in accordance with the frequency of the rpm differential signal and the total system transit, or response time, to that the bounce damping signal will be correctly phased over the expected frequency range of bounce oscillations.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
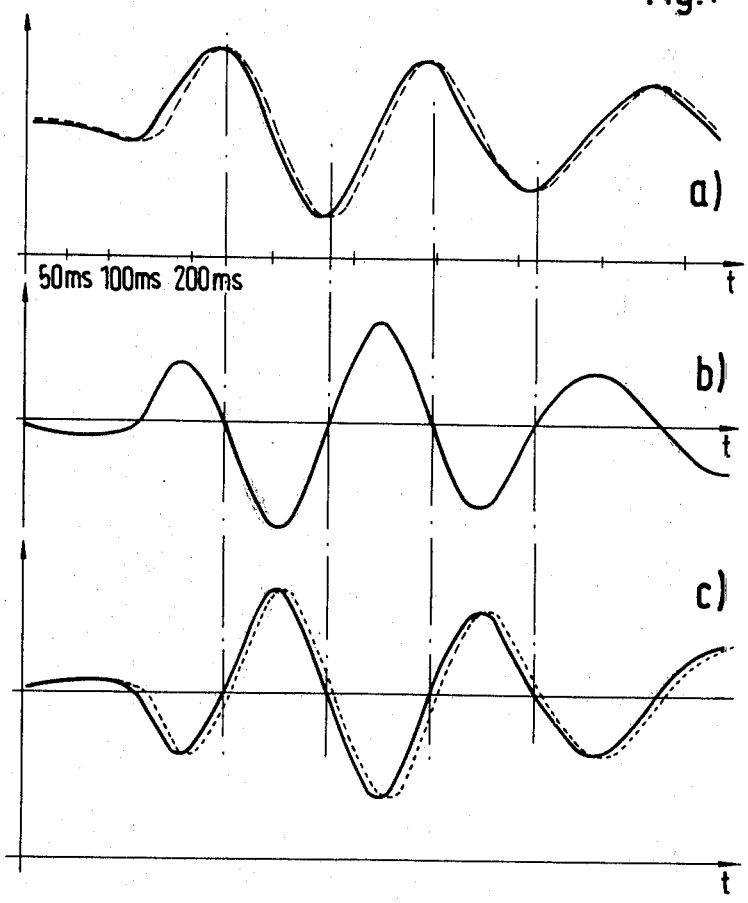
FIG. 1 shows pulse diagrams for low-frequency bounce oscillations as well as signal curves in the apparatus.

In the drawings, signal curves are shown in connection with an apparatus for damping preferably low-frequency bounce oscillations in an internal combustion engine. The signal curves illustrate the principle of bounce oscillation recognition and of the appropriate countercontrol. The data relate to an internal combustion engine with self-ignition. Bounce oscillations do occur in engines with externally supplied ignition as well, but in that case time factors are different, because the injection is not made directly into the cylinder but instead into the intake manifold, for example, and thus the reaction time on the part of the apparatus to bounce oscillations is substantially increased because of the fuel mixture transit time.

In FIG. 1*a*, the rpm of the crankshaft of an internal combustion engine with self-ignition is plotted over time. One solid line and one broken line represent symbolically the time delay involved in the detection of the rpm, and it becomes clear at the outset that the processable rpm signal lags behind the rpm value appearing at a particular time. This delay time is variable, depending on the type of rpm meter used; however, because of given physical properties, it is not equal to zero.

The rpm signal detected, which is differentiated according to time, produces the curve form given in FIG. 1*b*. The correspondingly negated signal is plotted in FIG. 1*c*. If this signal is supplied to the fuel metering apparatus, then the curve plotted as a dotted line results as the final effective correcting quantity. In the Diesel engine, the injection quantity corresponds closely to the available torque. Because of this association, the countercontrol which is possible can be recognized in FIGS. 1*a* and 1*c*; at times of increasing rpm, for example, a reduction in moment occurs, and during rpm decreases, there is an increase in moment. Imprecision in the countercontrol is caused by the individual transit times of the system components such as the rpm meter, the signal processing, and the final control element, which add up to a total transit time. Because this total transit time is constant (or rpm-dependent), it is the more disturbing the higher the frequency of the bounce oscillation. This accordingly means that the countercontrol becomes more imprecise with increasing frequency in the bounce oscillations. For this reason, at higher frequencies (in the engine type used in experiments, the threshold is a frequency of 4 Hz) countercontrol is first initiated on the occasion of the next subsequent wave half of the bounce oscillation; that is, the countercontrol signal is delayed in its effect for a predetermined period.

Figure 2:
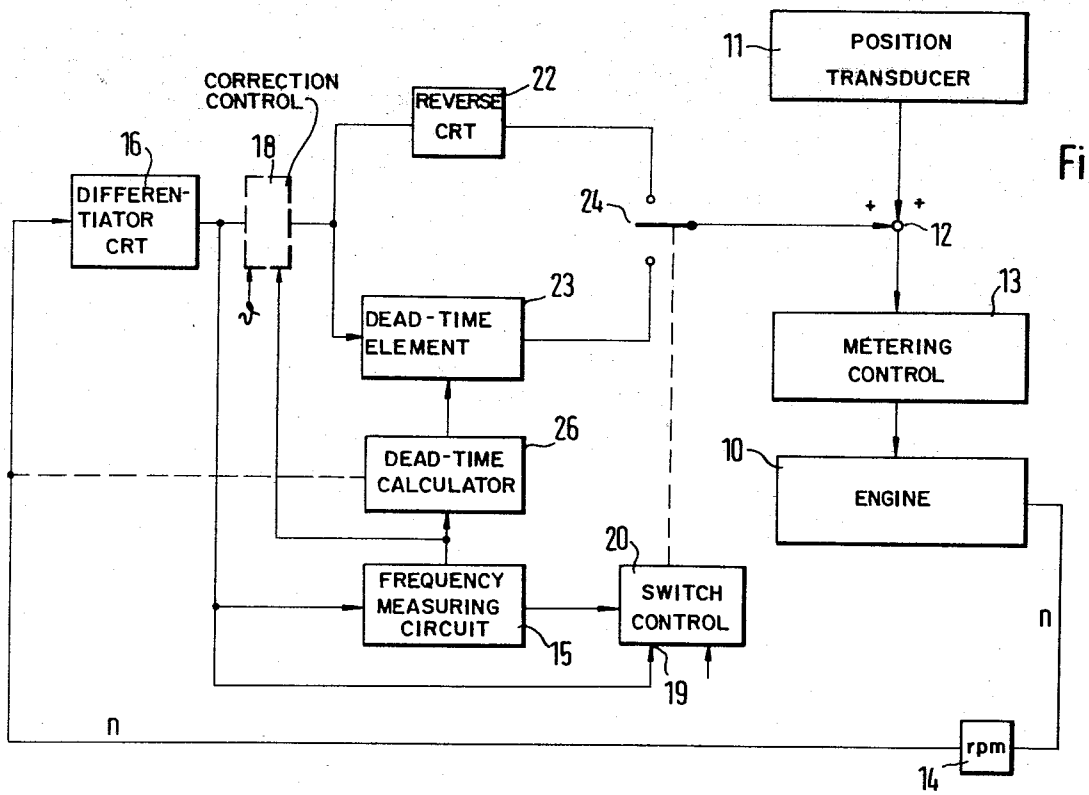
FIG. 2 shows in schematic form the apparatus itself.
Figure 3:
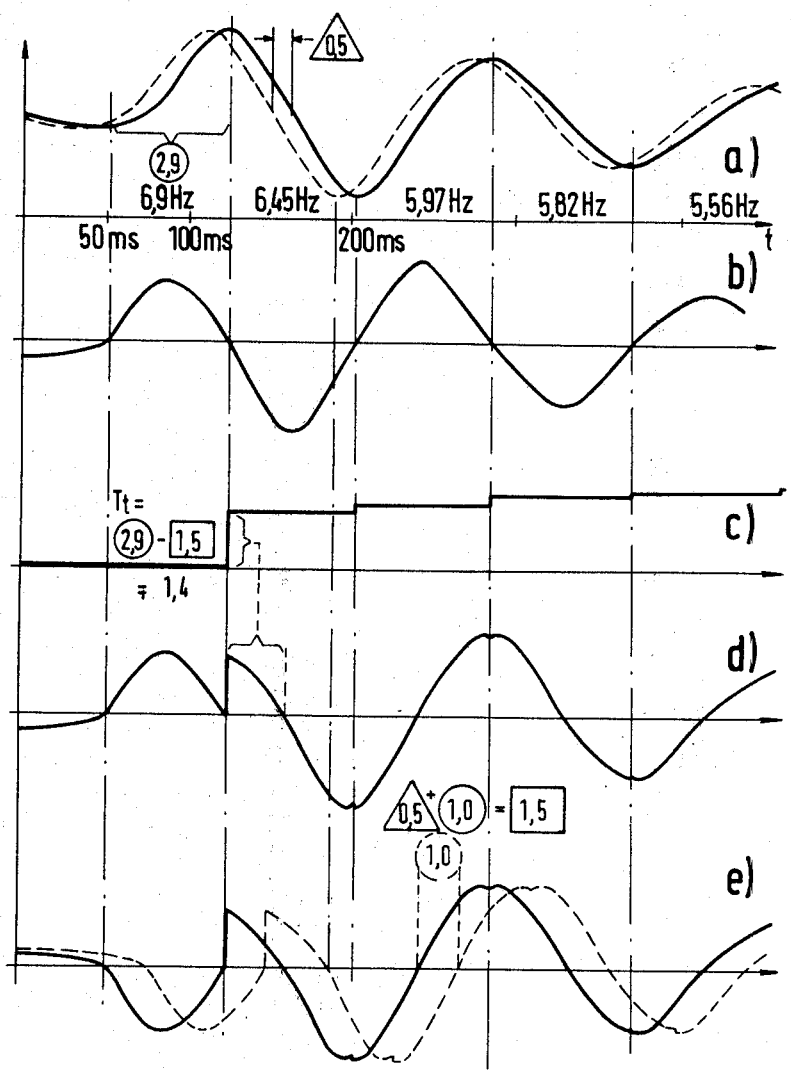
FIG. 3 shows signal curves in the apparatus in the case of high-frequency bounce oscillations.

Before the pulse diagrams applicable in FIG. 3 are explained, an apparatus for damping bounce oscillations in an engine will first be explained, with the aid of FIG. 2.

FIG. 2, in the form of a block diagram, shows an internal combustion engine with self-ignition in combination with a fuel metering system, an accelerator pedal and an apparatus in accordance with the invention for damping bounce oscillations. The engine itself is designated by reference numeral 10 and an accelerator pedal position transducer by reference numeral 11. The output signal of the position transducer 11 is sent via a summing element 12 to a fuel metering control system 13 of the engine 10. The output signal of an rpm meter 14 for the crankshaft rpm is delivered to a differentiation circuit 16. The output signal of the differentiation circuit 16 proceeds to a correction control circuit 18, a frequency measuring circuit 15 for the bounce oscillations and a first input 19 of a switch control circuit 20. On the output side, the correction control circuit 18 is linked, via a reversing circuit 22 and a dead-time element 23, to one contact of a three-position switch 24, whose output in turn is carried to the second terminal of the summing point 12. The three-position switch 24 is actuated by an output signal of the switch control circuit 20. The dead-time element 23 is triggered at the direction of a dead-time calculation circuit 26, which in turn receives its input signal from the frequency measuring circuit 15. During rpm-dependent dead times, the detected rpm signal is supplied to the dead-time element 23 via a second input.

In order for the apparatus for damping the bounce oscillations to function correctly, it is necessary, first, to recognize the bounce oscillations; second, to determine their phase status, frequency and, as needed, amplitude; third, to test whether the switch-on criteria for the apparatus for damping bounce oscillations have been met; and, fourth, to select a bounce damping countercontrol signal having the correct phase status and amplitude.

The bounce oscillations are recognized with the aid of the differentiation circuit 16 and of the frequency measuring circuit 15. The switch control circuit 20 answers the questions of whether and when to switch on the damping apparatus, while the correction control circuit 18 determines the type and magnitude of the countercontrol signal and, in certain types of intervention, its phase status as well; finally, the dead-time element 23, at higher bounce frequencies, effects a phase displacement of the countercontrol signal, so that the countercontrol is effected with the correct phase status.

The following alternatives are available as switching criteria for the switch control circuit 20:

(a) The rpm variation per unit of time must have exceeded a certain value, before a corrective intervention is undertaken in the fuel metering in the form of bounce damping.

(b) Because as a rule the bounce frequency is a function of resonance and is thus occasioned by the system as a whole, the switch control circuit 20 may furnish a switch-on signal upon each change in algebraic sign (+ or −) in the differentiated rpm signal; this switch-on signal is then followed by a switch-off signal whenever no new change in algebraic sign has appeared over the duration of one-half period of the lowest possible bounce frequency.

(c) The bounce damping apparatus is switched on whenever, upon the appearance of a change in algebraic sign of the differentiated rpm signal, the next change in algebraic sign appears within the duration of one-half period of the lowest possible bounce frequency. Upon the appearance of two changes in the algebraic sign of the differentiated rpm signal within the half-period duration of the lowest bounce frequency, the damping apparatus should intervene only after the second change in algebraic sign in the correct polarity.

(d) The damping apparatus switches on whenever the differentiated rpm signal shows a minimum or a maximum, and it switches off whenever within the duration of one-half period of the lowest possible bounce frequency no new minimum or maximum in the differentiated rpm signal appears.

(e) The switch control circuit 20 switches on after the passage of a predetermined period of time (for instance, $\frac{1}{8}$ period) for the duration of one-fourth period of the average or measured bounce frequency, whenever the twice-differentiated rpm signal has exceeded or fallen below a positive or negative value.

(f) The switch control circuit 20 switches on after the passage of a predetermined period of time (at a bounce frequency less than 5 Hertz: 1/16 period, for instance; at a bounce frequency greater than 5 Hertz, for instance, the duration is T/2 minus the system transit time) for the duration of one-fourth period of the measured bounce frequency, whenever the following conditions are satisfied:

(a) 1.25 Hertz < bounce frequency < 8.5 Hertz; and (b) the maximum (dn/dt) during one-half period must be greater than a constant value.

The possible alternatives for criteria for switching the apparatus on and off may also be combined with one another; for instance, a combination of criteria (a) and (b) is possible.

There are also various possible alternatives for the magnitude of the bounce damping countercontrol signal in response to the appearance of bounce oscillations:

(a) The supply of additional fuel is accomplished in proportion to the negated differential value of the rpm signal; that is, when there is a large increase in rpm, a large quantity of fuel is withdrawn, while in the case of a small decrease in rpm, a small quantity of fuel is added. In this case, the fuel countercontrol curve corresponds in form to the particular negated differential signal. The maximum and minimum can be additionally limited by a positive and/or a negative stop.

(b) The fuel correction signal assumes only a constant positive or negative value. The measurement of the constant quantity is then adapted to the given properties of the system as a whole, for instance to individual operational parameters such as temperature.

(c) The fuel quantity correction signal assumes constant values within several ranges of rpm increases, so that a stepping function is the result.

(d) Finally, the fuel quantity correction signal can also be formed in proportion to the difference between two rpm differentials dn1/dt and dn2/dt. Hence, dn1/dt is the derivative of the rpm at that actual instant, while dn2/dt is the derivative at that instant which precedes it by the duration of one-half period of the bounce oscillation at the measured frequency. The counter-coupled fuel quantity $$Q_K\,(dn1/dt)-(dn2/dt)$$

is continuously added to the fuel quantity signal, so that in this case, in principle, the switch-control circuit 20 can be omitted.

At a constant rpm increase, such as during acceleration, the counter-coupled fuel quantity correction signal becomes zero. However, during rapid variations in the rpm, such as those which occur when the accelerator pedal is fully depressed or during abrupt load changes, the fuel quantity signal may be weakened too much. In this case, an improvement can be attained via a restriction or suppression of the control variable for a period $t_o$ (for instance, $t_o < 1$ second), which is supposed to take effect during a particular variation in the intended fuel quantity signal.

In a preferred embodiment, the switch control circuit 20 then switches the three-position switch 24 into its upper position, or at higher frequencies into its lower position, whenever the derivative of the rpm according to time exceeds a value larger than 600 rpm/sec and a change in algebraic sign appears in the derivative. A switch back to the original position is then made whenever more than 250 milliseconds—this is the duration of a half period at a bounce frequency of 2 Hertz—have passed since the last change in algebraic sign of the derivative. The switch control circuit 20 thus includes threshold switches, an apparatus for signal polarity recognition, a re-triggerable timing circuit and logic gates.

The upper switching position of the three-position switch 24 is useful only at low bounce frequencies, that is, with a short system transist time in comparison with the period duration. Then, the reaction time of the system is negligible and good results can be attained in the bounce damping with an immediate countercontrol.

If the bounce frequency attains higher frequencies, particularly between approximately 4 and 10 Hertz, then when the system transit times are not negligible it is recommended that a dead-time element be introduced into the countercontrol circuit. This measure then effects a phase-displaced countercontrol at a subsequent time. This measure does have the disadvantage of the delayed onset of bounce damping; however, the countercontrol cannot be more precisely selected with respect to both phase status and magnitude. This type of countercontrol will be explained with the aid of FIG. 3.

FIG. 3 illustrates signals of the damping apparatus for bounce oscillations corresponding to the subject of FIG. 2 in operation with a dead-time element.

In FIG. 3*a*, the solid and the broken lines plot the detected crankshaft rpm and the actual crankshaft rpm. A phase difference of 0.5 time units will be seen. Reference is made to these time units for the sake of simplicity of illustration, so as not to have to make calculations with actual time values.

FIG. 3*b* shows the detected rpm signal differentiated according to time.

For the dead time, plotted in FIG. 3, a value is selected in accordance with the formula $$T_T=(T/2(\text{bounce oscillation})-\text{total transit time})$$

The value of the total transit time must include all the individual transit times of the system, beginning with the rpm detection through and including the reaction time of the fuel metering control element. A value of 1.5 time units is assumed for this total transit time, broken up into 0.5 units for the rpm detection and 1.0 units for the fuel metering control system.

For the duration of one-half period of the derived signal, for instance, the values of 2.9 time units are obtained, so that according to the above formula a dead time of $T_T=1.4$ is obtained. This time must be bridged over in order to be able to effect a correctly phased countercontrol of the bounce oscillations in a phase-displaced manner.

FIG. 3*d* shows the output signal of the dead-time element 23. It will be seen that there is a phase displacement, by the amount of the dead time calculated at certain times, appearing at those times, particularly during the passage of the rpm derivative signal according to FIG. 3*b* through the zero point. This dead time is newly calculated upon each passage through the zero point by the rpm derivative signal.

Finally, in FIG. 3, the correction signal at the fuel metering control element input and the actual correction quantity are shown with a system-dictated phase displacement of one time unit. What is important here is the corresponding phase control during the various passages through zero by the derivative signal.

Now if the time relationship of the actual crankshaft rpm of FIG. 3*a* is compared with the actual effective quantity in the internal combustion engine which the broken line of FIG. 3*e* represents, then it will be seen that directly following an initial "inswing" phase, an exact countercontrol is effected such that in the event, for instance, of a renewed rpm increase at approximately 190 milliseconds on the time scale of FIG. 3*a*, the correction quantity corresponding to FIG. 3*e* becomes negative, and a countercontrol thus takes place which is correct in terms of time. The dead time at a particular time is calculated in the dead-time calculation circuit 26 of FIG. 2 in combination with the frequency measuring circuit 15 shown there. In essence, this is a counting-out process of the duration of one-half period of the bounce oscillation and a subsequent subtraction of the total transit time as a constant value (or one which is rpm-dependent as well).

A second exemplary embodiment will now be discussed in combination with the subject of FIG. 2. With bounce oscillations having a frequency lower than 5 Hertz, the three-position switch 24 is in the upper position, so that the output signal of the correction control circuit 18 is directly subtracted from the intended fuel quantity signal coming from the accelerator pedal 11. At a bounce frequency equal to or greater than 5 Hertz, in contrast, the three-position switch 24 is in the lower position. However, the precondition is a corresponding control signal from the switch control circuit 20, which appears whenever the bounce frequency f is in the range of $$1.25\ \text{Hz} \leqq f \leqq 8.5\ \text{Hz},$$

and the crankshaft rpm is greater than 800 rpm (idling rpm=750 rpm).

When it is ascertained whether an algebraic sign change has appeared in the bounce signal or not, the rpm must vary in the appropriate direction by at least 30 rpm.

This hysteresis is intended to filter out imprecisions in the rpm detection or unconcentric running of the engine, especially at low bounce frequencies.

The limitation of the intervention to a bounce frequency of 8.5 Hertz has been made in the exemplary embodiment because uncontrolled rpm jumps occur at higher crankshaft rotations (N>2500 Min) and low load. The reason for this is found in the rough running of the engine which often occurs and in the associated high-frequency oscillations, which are outside the resonance range of the engine/vehicle unit. At bounce frequencies of less than 5 Hertz, the output of the correction control stage 18 is switched through to the summing point 12. At higher bounce frequencies, that is, between 5 and 8.5 Hertz, the output of the dead-time element 23 is applied to this summing point.

Figure 4:
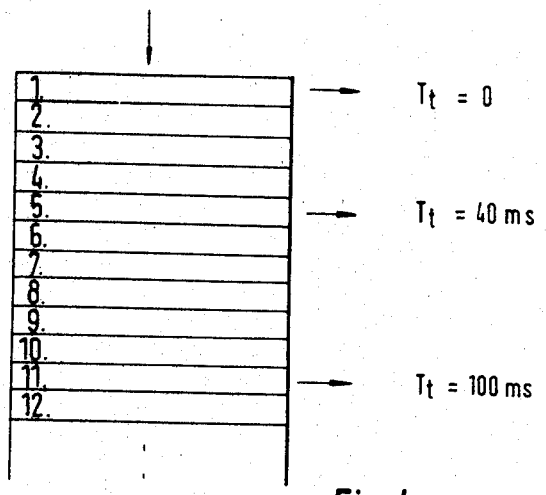
FIGS. 4 and 5 each show one exemplary embodiment of a dead-time element used in the apparatus.

The dead-time element 23 corresponds in essence to a delay element and is efficiently embodied as a slide register. Two alternatives of such an embodiment are shown in schematic form in FIGS. 4 and 5. In the first version shown in FIG. 4, the place contents of the memory are continuously rewritten, and the results, which are dependent on dead time, are produced at various and clock-time dependent places in the memory.

Figure 5:
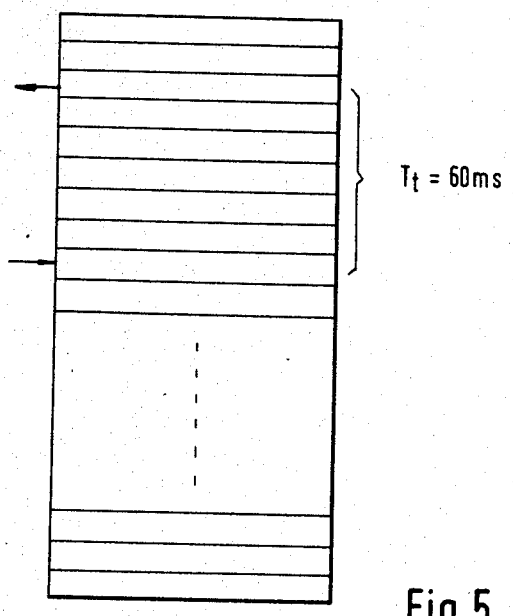

In contrast, in the second version of FIG. 5, the memory contents at a particular time remain constant during one revolution cycle; only the read-in and read-out locations vary in accordance with clock time and dead time. With a constant dead time, that is, a constant bounce frequency, the distance between the input and the output location remains constant. The advantage of the second version relative to the first is in the short computation time, because the data do not need to be switched over in memory at the instant of each data pickup.

The damping apparatus for bounce oscillations shown schematically in FIG. 2 are efficiently realized by means of a computer, because a digital computer component already is available as the dead-time element 23. Because of the given relationships between input variables and output variables of the damping apparatus, the programming of an appropriate computer program is within the capacity of a professional programmer.

The invention relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An apparatus for damping low-frequency bounce oscillations in an internal combustion engine having first signal generating means for generating at least one operational signal and a fuel metering means for supplying fuel to the engine in accordance with said at least one operational signal, which comprises:

rpm signal generating means for generating an rpm signal proportional to the engine rpm;

signal differentiation means, connected to receive said rpm signal, for generating an rpm differential signal proportional to the rate of change of said rpm signal with respect to time;

countercontrol signal generating means, connected to receive said rpm differential signal, for supplying a damping signal to said fuel metering means upon the occurrence of predetermined characteristics of said rpm differential signal indicating bounce-induced oscillations in the engine speed, wherein said fuel metering means enriches or leans said fuel in said response to said damping signal.

2. An apparatus, as described in claim 1, wherein said countercontrol signal generating means comprises a phase-shifting means, connected to receive said rpm differential signal, for shifting the phase of said rpm differential signal to produce said damping signal.

3. An apparatus, as described in claim 2, wherein said phase-shifting means comprises a phase reversal, or inversion, circuit.

4. An apparatus, as described in claim 2, wherein said phase-shifting means comprises an adjustable phase-shifting means for shifting the phase of said rpm differential signal in accordance with the frequency of said rpm differential signal and a total system transit time of said apparatus.

5. An apparatus, as described in claim 4, wherein said countercontrol signal generating means comprises switching means for connecting said adjustable phase-shifting means to supply said damping signal to said fuel metering means whenever said rpm differential signal oscillates at a frequency greater than 4 Hertz.

6. An apparatus, as described in claim 4, wherein said adjustable phase-shifting means comprises a slide register with locally fixed information and cell-for-cell read-in and read-out.

7. An apparatus, as described in claim 4, wherein said adjustable phase-shifting means comprises:

a controllable dead time element for producing a phase-shifted rpm differential signal which is said damping signal, wherein the phase shift, or dead time, is proportional to a control signal supplied to the dead time element;

a frequency measuring means for generating frequency signals proportional to the oscillation frequency of said rpm differential signal; and computer means, connected to receive said frequency signals, for supplying said control signal to said dead time element.

8. An apparatus, as described in claim 4, wherein said countercontrol signal generating means comprises switching means for connecting said adjustable phase-shifting means to supply said damping signal to said fuel metering means whenever said rpm differential signal oscillates at a frequency within the range of 1.25 Hertz to 10 Hertz.

9. An apparatus, as described in claim 4, wherein said adjustable phase-shifting means provides a phase shift, or dead time, equal to one-half of the period duration of said rpm differential signal less said total system transit time.

10. An apparatus, as described in claim 4, wherein said adjustable phase-shifting means comprises a slide register with continuous writing-in, further data transmittal, and cell-for-cell read-out.

11. An apparatus, as described in claim 1, wherein said damping signal is an alternating signal having constant positive and negative magnitudes.

12. An apparatus, as described in claim 1, wherein said damping signal is an alternating signal having positive and negative magnitudes which are constant within a predetermined range of magnitudes of said rpm differential signal, whereby the magnitude of said damping signal is changed by constant increments or steps as the magnitude of said rpm differential signal changes.

13. An apparatus, as described in claim 1, wherein said damping signal is an alternating signal which is proportional to, and phase-displaced from, said rpm differential signal.

14. An apparatus, as described in claim 1, wherein said damping signal is proportional to the difference in the magnitude of said rpm differential signal at two different instants.

15. An apparatus, as described in claim 14, wherein the time difference between said two different instants corresponds to the duration of one-half period of the average oscillation frequency of said rpm differential signal.

16. An apparatus, as described in claim 14, wherein said damping signal is added to said at least one operational signal and supplied to said fuel metering means.

17. An apparatus, as described in claim 16, wherein said at least one operational signal is an output signal of an accelerator pedal position transducer.

18. An apparatus, as described in claim 1, wherein countercontrol signal generating means comprises:

signal processing means for producing said damping signal from said rpm differential signal;

switch means, having an open position and a closed position, for connecting said signal processing means to supply said damping signal to said fuel metering means whenever said switch means is closed; and switch control means, connected to receive said rpm differential signal, for closing said switch means upon the occurrence of said predetermined characteristics of said rpm differential signal indicating bounce-induced oscillations in the engine speed.

19. An apparatus, as described in claim 18, wherein said switch control means closes said switch means when said rpm differential signal exceeds a predetermined value.

20. An apparatus, as described in claim 18, wherein said switch control means closes said switch means when a second algebraic sign change of said rpm differential signal occurs within a predetermined period of time after the occurrence of a first algebraic sign change of said rpm differential signal.

21. An apparatus, as described in claim 20, wherein said switch control means closes said switch means when said rpm differential signal exceeds a predetermined value.

22. An apparatus, as described in claim 18, wherein said switch control means closes said switch means when the frequency of said rpm differential signal falls within a predetermined range of frequencies.

23. An apparatus, as described in claim 22, wherein said switch control means closes said switch means when said rpm differential signal exceeds a predetermined value and when a second algebraic sign change of said rpm differential signal occurs within a predetermined period of time after the occurrence of a first algebraic sign change of said rpm differential signal.

24. An apparatus, as described in claim 18, wherein said switch control means deactivates said switch means whenever no algebraic sign change in said rpm differential signal occurs within a second predetermined period of time after the occurrence of a previous algebraic sign change in said rpm differential signal.

25. An apparatus, as described in claim 18, wherein said switch control means actuates said switch means at a predetermined time after the occurrence of said predetermined characteristics of said rpm differential signal indicating bounce-induced oscillations of the engine.

26. An apparatus, as described in claim 18, wherein:

said switch means is a three-way switch having first, second and third terminals which are non-conductive therebetween when said three-way switch is disposed in a first position or state, said first terminal being connected to said fuel metering means, said first terminal being connected to said second terminal when said three-way switch is disposed in a second position or state, and said first terminal being connected to said third terminal when said three-way switch is disposed in a third position or state;

said signal processing means includes phase-reversing means, having an input connected to receive said rpm differential signal and an output connected to said second terminal of said switch means, for inverting said rpm differential signal, and an adjustable phase-shifting means, having an input connected to receive said rpm differential signal and an output connected to said switch means third terminal, for shifting the phase of said rpm differential signal in accordance with the frequency of said rpm differential signal and a total system transit time of said apparatus; and said switch control means includes first switch operating means for switching said three-way switch to its first position when the frequency of said rpm differential signal falls below a predetermined minimum value, second switch operating means for switching said three-way switch to its second position when the frequency of said rpm differential signal exceeds a second predetermined value at least as great as said predetermined minimum value, and third switch operating means for switching said three-way switch to its third position when the frequency of said rpm differential signal exceeds a third predetermined value greater than said second predetermined value.

* * * * *